United States Patent [19]

Hujsak et al.

[11] 3,964,547

[45] June 22, 1976

[54] RECOVERY OF HEAVY HYDROCARBONS FROM UNDERGROUND FORMATIONS

[75] Inventors: Karol L. Hujsak, Tulsa, Okla.; Thomas S. Buxton, Calgary, Canada

[73] Assignee: Amoco Production Company, Tulsa, Okla.

[22] Filed: Oct. 29, 1974

[21] Appl. No.: 518,680

Related U.S. Application Data

[63] Continuation of Ser. No. 323,542, Jan. 15, 1973, abandoned.

[52] U.S. Cl. ..... 166/269; 166/303

[51] Int. Cl.[2] ..... E21B 43/16

[58] Field of Search ..... 166/269, 272, 276, 303, 166/306

[56] References Cited

UNITED STATES PATENTS

| | | | |
|---|---|---|---|
| 3,061,009 | 10/1962 | Shirley | 166/303 |
| 3,145,773 | 8/1964 | Vorda et al. | 166/306 |
| 3,221,810 | 12/1965 | Marx | 166/269 |
| 3,358,759 | 12/1967 | Parker | 166/269 |
| 3,369,601 | 2/1968 | Bond et al. | 166/269 |
| 3,410,344 | 11/1968 | Cornelius | 166/303 |
| 3,533,472 | 10/1970 | Cornelius | 166/303 |
| 3,580,338 | 5/1971 | Sparlin | 166/269 |
| 3,583,488 | 6/1971 | Hutchison | 166/303 |
| 3,667,545 | 6/1972 | Knight | 166/269 |
| 3,674,092 | 7/1972 | Bandyopadhyay | 166/269 |

*Primary Examiner*—Frank L. Abbott
*Assistant Examiner*—Jack E. Ebel
*Attorney, Agent, or Firm*—John D. Gassett; Paul F. Hawley

[57] ABSTRACT

A method of producing highly viscous oil from an underground formation penetrated by a well. Steam is injected through a first channel into the lower part of the formation. At the same time, previously recovered oil from the formation is injected through the well in a channel surrounding the steam channel to the upper part of the formation. This native oil insulates the formation from the steam and also serves to block the steam from rising in the formation. The heated oil can then be recovered from an adjacent well or injection can be stopped and the oil can be recovered from the well through which the fluid was injected.

2 Claims, 1 Drawing Figure

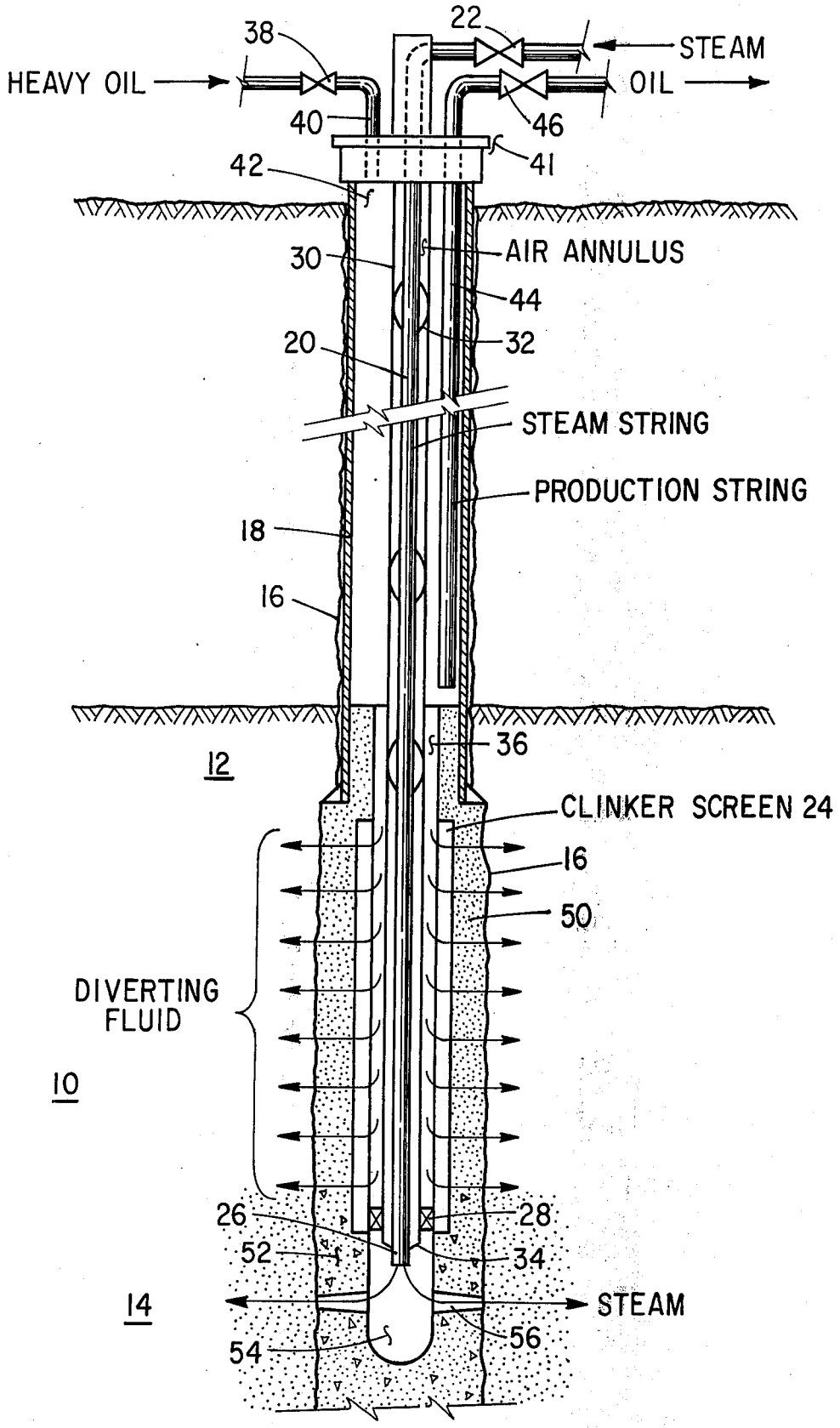
22
38
STEAM
HEAVY OIL
OIL
40
46
42
41
AIR ANNULUS
30
44
20
32
STEAM STRING
PRODUCTION STRING
18
16
36
12
CLINKER SCREEN 24
16
50
DIVERTING FLUID
10
26
28
52
34
14
STEAM
54
56

RECOVERY OF HEAVY HYDROCARBONS FROM UNDERGROUND FORMATIONS

This is a continuation of application Ser. No. 323,542, filed Jan. 15, 1973 and now abandoned.

BACKGROUND OF THE INVENTION

1. Field of the Invention

This invention relates to producing heavy or highly viscous hydrocarbons from a subsurface formation. It relates especially to a method of injecting steam in the lower portion of the formation and "heavy" oil in the upper portion. This heavy oil is also injected in a channel in the well surrounding the steam to form an insulation zone.

2. Setting of the Invention

Oil and gas are produced from underground formations through wellbores drilled from the surface to the formation. The oil and gas are contained in the pores of underground rocks or sand. The nature of the hydrocarbons found in these underground rocks or formations varies quite widely. Some of the hydrocarbons are in the form of gas. Others are in the form of oil having a low viscosity so that it will flow relatively free or easy. Still another type is the heavy or viscous oil which will hardly flow from the formation unless special means are taken to obtain such flow. Some heavy hydrocarbons are in the form of tars or bitumens. The most notable example is the solid or semisolid hydrocarbons or bitumens of the McMurray bituminous sand outcropping along the Athabasca River in Canada. The Athabasca tar is difficult to produce because it maintains a high viscosity even at high temperatures. For example, even at the 400° F temperature of saturated steam at a pressure of 235 pounds per square inch, the Athabasca tar viscosity is still about 8 cps. There are many different ways which have been tried for producing the Athabasca tar. A typical representation of such methods is U.S. Pat. No. 3,155,160, F. F. Craig, Jr., et al, which teaches a method of recovery of the heavy oil by steam extraction.

BRIEF DESCRIPTION OF THE INVENTION

This is a method for recovering heavy oil from a relatively thick, underground reservoir. Steam is injected through a tubing or steam string suspended in a well drilled to the formation and extending to the lower part of the formation. A heavy crude or oil is pumped down the well in an annular channel surrounding the steam string and into the upper part of the formation. This heavy oil serves two functions. One, it insulates the steam channel from the surrounding formation. Two, when it is injected into the upper part of the formation, it cools and becomes more viscous and blocks the upward flow of steam which is being injected into the lower part. It has been found that the lower part of the Athabasca tar sands contains the highest concentration of hydrocarbons, but the upper or leaner portion of the formation has the greater permeability. If steam is merely injected through a well drilled into the formation without proper precautions, it will quickly channel to the upper part of the formation, thus bypassing the richer, lower portion. With our invention, this upward flow is blocked and the steam will heat the lower portion where the richer concentrations are and will improve recovery. After the formation has been heated a sufficient time, the steam into the well can be cut off and oil can be produced from the same well.

Alternatively, an offset well can be used as the producing well.

BRIEF DESCRIPTION OF THE DRAWING

Various objectives and a better understanding can be had of the invention by the following description taken in conjunction with the drawing, which shows a diagrammatic cross-section of a heavy-oil sand having a well therein which is equipped for the practice of this invention.

DETAILED DESCRIPTION OF THE INVENTION

Attention is directed to the drawing which shows a wellbore 16 drilled into a subsurface formation 10, which contains heavy crude or hydrocarbons. This formation has an upper portion 12 and a lower portion 14 which represents a part of the same formation 10 but having different characteristics. For example, in the Athabasca tar sands, the lower portion 14 normally has much more hydrocarbons therein than does the upper portion 12. However, the upper portion 12 has been found to have higher permeability. Thus, a fluid used to help recover the oil will flow mostly through the upper part unless special steps are taken to prevent this. As mentioned above, one of the ways of trying to produce these heavy oil sands is to heat the formation so that the heavy oil becomes much less viscous and then can be displaced and produced much easier. One of the methods mentioned is the injection of steam. This has met with some success; however, it does have problems. For example, if it is injected, without special precautions, into a formation such as formation 10, most of the steam will flow to the upper portion 12. This is because the permeability there is considerably higher than the lower richer part. However, with that prior steam-injecting system, only the leaner part of formation 10 is heated by the steam and recovery is much less than desired. Our invention teaches a way whereby the steam is injected into the lower part 14 of the formation and is prevented from rising to the more permeable part, at least for some considerable distance from the well bore. Thus, we heat the richer lower portion. This method will become more apparent as the description progresses.

Well 16 is lined with a casing 18. This casing can be of a special metal to withstand high temperatures which are encountered in steam injection. In a preferred completion, casing 18 is terminated in the upper part of zone 10. A tubing string 20 is suspended within casing 18. This can be called the "steam string" as the steam source, not shown, is connected through valve 22 at the surface to string 20. This string 20 extends through the bore or passage 36 of a special screen 24 and opens at its lower end 26 to the bottom of the well. Cement 52 is placed in the lower end of the borehole at a level which is just below screen 24. A bore 54, aligned with bore 36 of screen 24, is provided in cement 52. Perforations 56 establishes communication between bore 54 and the lower portion 14 of formation 10. The annulus between screen 24 and wellbore 16 is filled with sand to form a sandpack 50. The sand is typically sized from 10 to 20 mesh.

A string of tubing 30 surrounds steam string 20, which is centered therein by centralizers 32. This air string 30 is open at the surface to the atmosphere and is sealed at the lower end at 34 with the outer wall of tubing 20.

Screen 24 must be one which can withstand high temperatures. It is preferably a hollow, cylindrical, oil-permeable sleeve, fabricated from a ground hydraulic cement clinker selected from the group consisting of calcium silicate, calcium aluminate, and aluminate cement with the clinker having a particle-size ranging from about minus 10 to about plus 40 mesh. Ways of manufacturing such a screen are fully described in U.S. Pat. No. 3,244,229, issued Apr. 5, 1966, to Karol L. Hujsak and William G. Bearden. Screen 24 then has a longitudinal passage 36 that is somewhat larger than the outer diameter of air string 30. Both air string 30 and steam string 20 extend through passage 36 of screen 24. The annulus between air string 30 and passage 36 near the lower end is closed by annular packer 28.

Means are provided to inject a heavy crude oil into the system. This includes a valve 38 and a conduit 40 entering through the wellhead and opening into annulus 42, which is between the outer wall of air tubing string 30 and the inner wall of casing 18. Tar or heavy oil is provided to valve 38 from a source not shown. Annulus 42 extends the entire length of the well and is in communication with passage 36, which is the central passage of screen 24. An oil-producing string 44 is provided and extends from the surface to just above the formation 10. It extends through wellhead 41 and has valve 46 above the wellhead.

Having described the main components of the well completion shown in the drawing, attention will now be directed toward the operation of this system. It is believed that the invention can best be understood by giving an example of an operation we performed in the Athabasca tar sand supra using our invention, although the invention will not be limited to such example. Formation 10 is an Athabasca tar sand formation, which is typically about 1,000 feet below the surface and has a thickness of between about 50 and 200 feet. Where well 16 was drilled, it was about 100 feet thick. The permeability varies and decreases with depth. The permeability at 12 (the upper part) was about 8 darcies and at 14 (the lower part) about 2 darcies. Oil or tar saturation in portion 12 was about 4% by weight and at 14 about 18% by weight. A hot heating fluid was injected through valve 24 and string 20. The preferred heating fluid was steam as it can carry tremendous amounts of heat and does no damage to the formation. Steam was injected at a pressure so that it readily entered the formation. In the example of this operation, we injected steam (75% quality) at a rate of 1 barrel of water equivalent per minute (20,000,000 BTU/hr.) at a pressure of about 1,350 psi at the wellhead. The steam was injected into the bottom 8 to 12 feet of the formation. We continued injecting steam until we had injected 8.5 billion BTU. At the same time that we injected the steam, we also injected an insulating and diverting fluid through valve 38. (A very suitable and preferred fluid is oil which has been produced from the formation 10 itself.) In our operation we did inject oil which had previously been recovered from the tar sand. This oil was quite compatible with the formation. We injected it through annulus 42 which completely surrounds air string 30, which in turn surrounds the steam string. As the oil flowed downwardly through annulus 42, it formed an insulating medium for the steam. The oil flowed out through screen 24 into formation 10. This oil, that was added by this injection, increased the saturation of oil around the wellbore in the upper part of the formation and prevented the steam from flowing upwardly. The cooling and blocking fluid or oil was warm enough so that we could pump it through annulus 42. We injected oil at the rate of about 5 barrels per day for a period of 18 days for a total injection of 90 barrels. A suitable range for the rate of injection is from about 5 to about 100 barrels per day. As we were able to inject considerable oil at the upper part of the formation, we knew that we were blocking the upflow of steam in at least the immediate vicinity of the well. Thus, the steam had to penetrate the lower richer part of the formation. This was our goal.

While the above invention has been described in detail, it is to be understood that various modifications can be made thereto without departing from the spirit or scope of the invention.

We claim:

1. A method of injecting both a heating fluid and an insulating fluid and producing a heated hydrocarbon through a single well drilled through a formation having an upper high permeability part lean in hydrocarbons, and a lower low permeability part rich in hydrocarbons which comprises:

a. establishing within said single well a first channel extending from the surface to said lower part of said formation, b. establishing a second channel within said well surrounding the first channel and extending from the surface to an upper part of said formation, said second channel having no fluid communication within said well with said first channel;

c. injecting a heating fluid through said first channel to said lower part of said formation to heat the hydrocarbons therein;

d. injecting an insulating fluid through said second channel into said upper part of said formation simultaneously with the injection of said heating fluid to insulate said upper part of said formation from said heating fluid in said first channel, and to block the upward flow of said heating fluid in said formation;

e. establishing a producing channel through said said single well extending from the surface to said formation and producing hydrocarbons through said producing channel.

2. A method of injecting both a heating fluid and an insulating fluid through a single well drilled through a formation having an upper high permeability part lean in hydrocarbons and a lower low permeability part rich in hydrocarbons which comprises:

a. establishing within said single well a first channel extending from the surface to said lower part of said formation including placing cement in the lower portion of said well and forming a passage through said cement to the lower part of said formation;

b. establishing a second channel within said well surrounding the first channel and extending from the surface to an upper part of said formation, said second channel having no fluid communication within said well with said first channel, said step of establishing a second channel includes placing a sand screen having a longitudinal bore in the well adjacent to the upper portion of said formation and forming a first annular portion within said bore to form a part of said second channel, said annular portion connects with said passage through said cement;

c. injecting a heating fluid through said first channel into the lower part of said formation to heat the oil therein; and d. injecting an insulating fluid through second channel including said sand screen into said upper part of said formation simultaneously with the injection of said heating fluid to insulate said upper part of said formation from said heating fluid in said first channel, and to block the upward flow of said heating fluid in said formation.

* * * * *